US007609234B2

(12) United States Patent
Cho et al.

(10) Patent No.: US 7,609,234 B2
(45) Date of Patent: Oct. 27, 2009

(54) PIXEL CIRCUIT AND DRIVING METHOD FOR ACTIVE MATRIX ORGANIC LIGHT-EMITTING DIODES, AND DISPLAY USING THE SAME

(75) Inventors: Gyu-Hyeong Cho, Daejeon (KR); Young-Suk Son, Hwasung (KR); Sang-Kyung Kim, Daejeon (KR); Min-Chul Lee, Daegu (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 733 days.

(21) Appl. No.: 11/232,819

(22) Filed: Sep. 22, 2005

(65) Prior Publication Data

US 2006/0132053 A1 Jun. 22, 2006

(30) Foreign Application Priority Data

Dec. 16, 2004 (KR) ..... 10-2004-0107255

(51) Int. Cl.
*G09G 3/30* (2006.01)

(52) U.S. Cl. ..... 345/76; 345/82; 315/169.3

(58) Field of Classification Search ..... 345/76–84, 345/211, 690, 691; 315/169.3; 313/463
See application file for complete search history.

(56) References Cited

U.S. PATENT DOCUMENTS 6,362,798 B1 * 3/2002 Kimura et al. ..... 345/55
2001/0026261 A1 * 10/2001 Walker et al. ..... 345/98
2003/0103022 A1 * 6/2003 Noguchi et al. ..... 345/77
2003/0214522 A1 * 11/2003 Kageyama et al. ..... 345/690
2004/0196394 A1 * 10/2004 Nakajima ..... 348/254

OTHER PUBLICATIONS

Hajime Akimoto et al., SID 02 Digest, 972-975, 2002.
Hiroshi Kageyama et al., SID 03 Digest, 96-99, 2003.
Hiroshi Kageyama et al., SID 04 Digest, 1394-1397, 2004.

* cited by examiner

*Primary Examiner*—Amare Mengistu
*Assistant Examiner*—Dmitriy Bolotin
(74) *Attorney, Agent, or Firm*—Bachman & LaPointe, P.C.

(57) ABSTRACT

Disclosed herein are a pixel circuit and driving method for active matrix Organic Light-emitting Diodes (OLEDs), and a display using the same. The pixel circuit includes a Voltage Control Current Source (VCCS), a high gain amplifier, a storage capacitor, and first and second switches. The VCCS is configured to drive OLEDs. The high gain amplifier is configured such that the control input signal of the VCCS causes the VCCS to be placed in an ON or OFF state. The storage capacitor is located between the input terminal of the high gain amplifier and a data line so as to assign the ON-time of the VCCS. The first and second switches are configured to be controlled through a scan line so as to store voltage in the storage capacitor and control the light-emitting time of the OLEDs, and are formed the input terminal of the high gain amplifier and the input terminal of the VCCS, respectively.

11 Claims, 8 Drawing Sheets

[Figure 1]
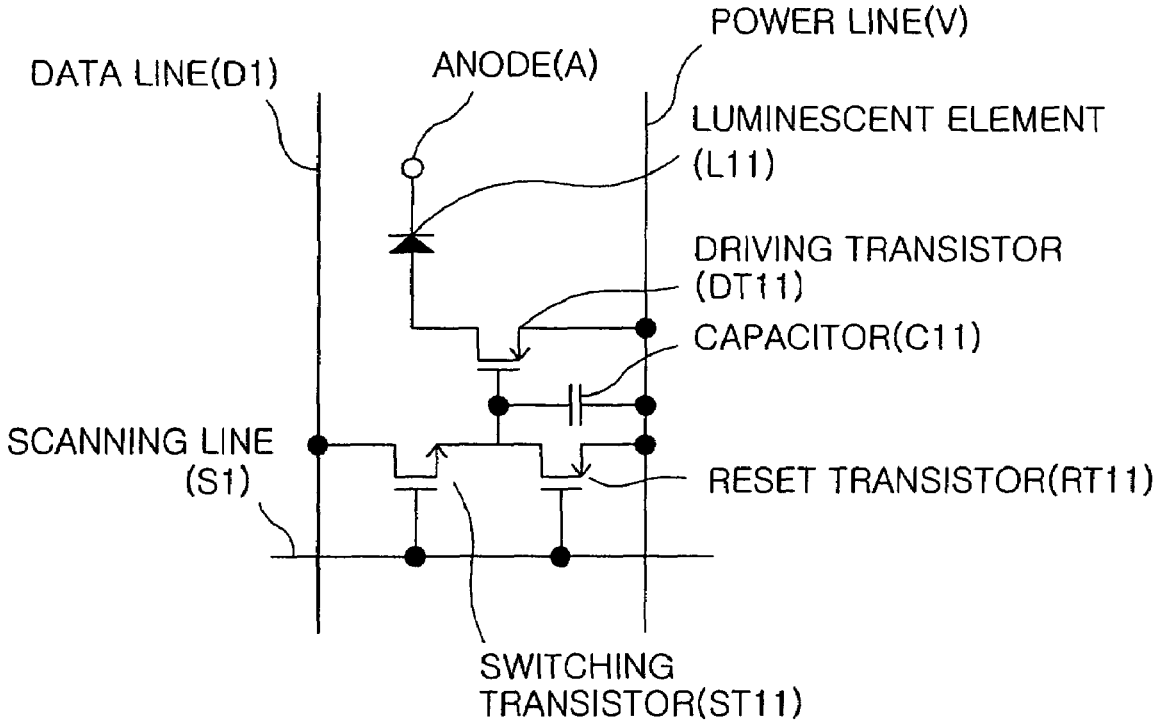

[Figure 2a]
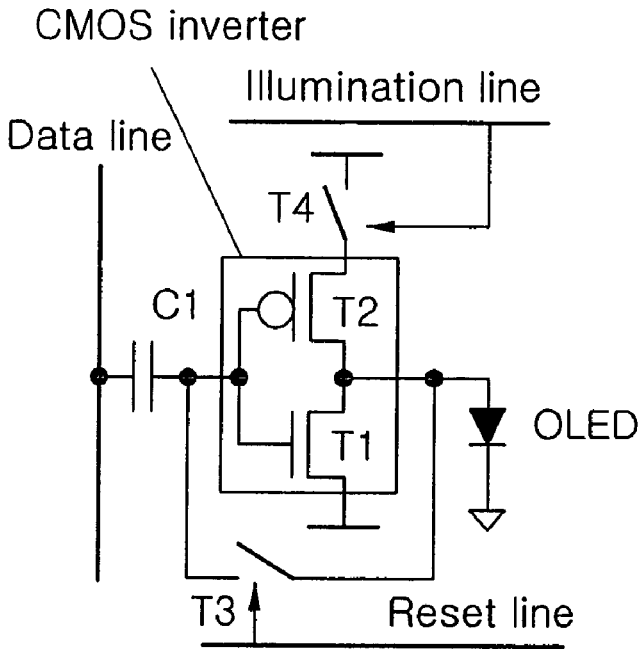
[Figure 2b]
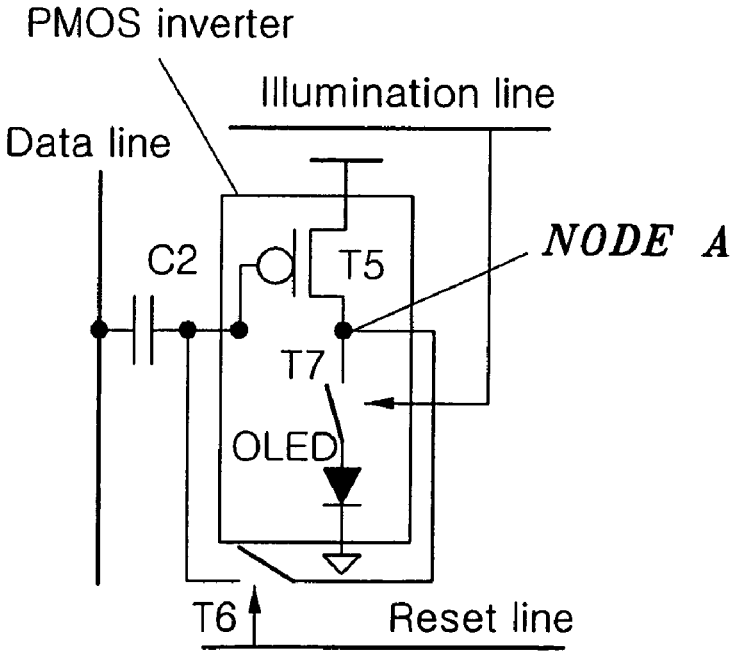

[Figure 3]
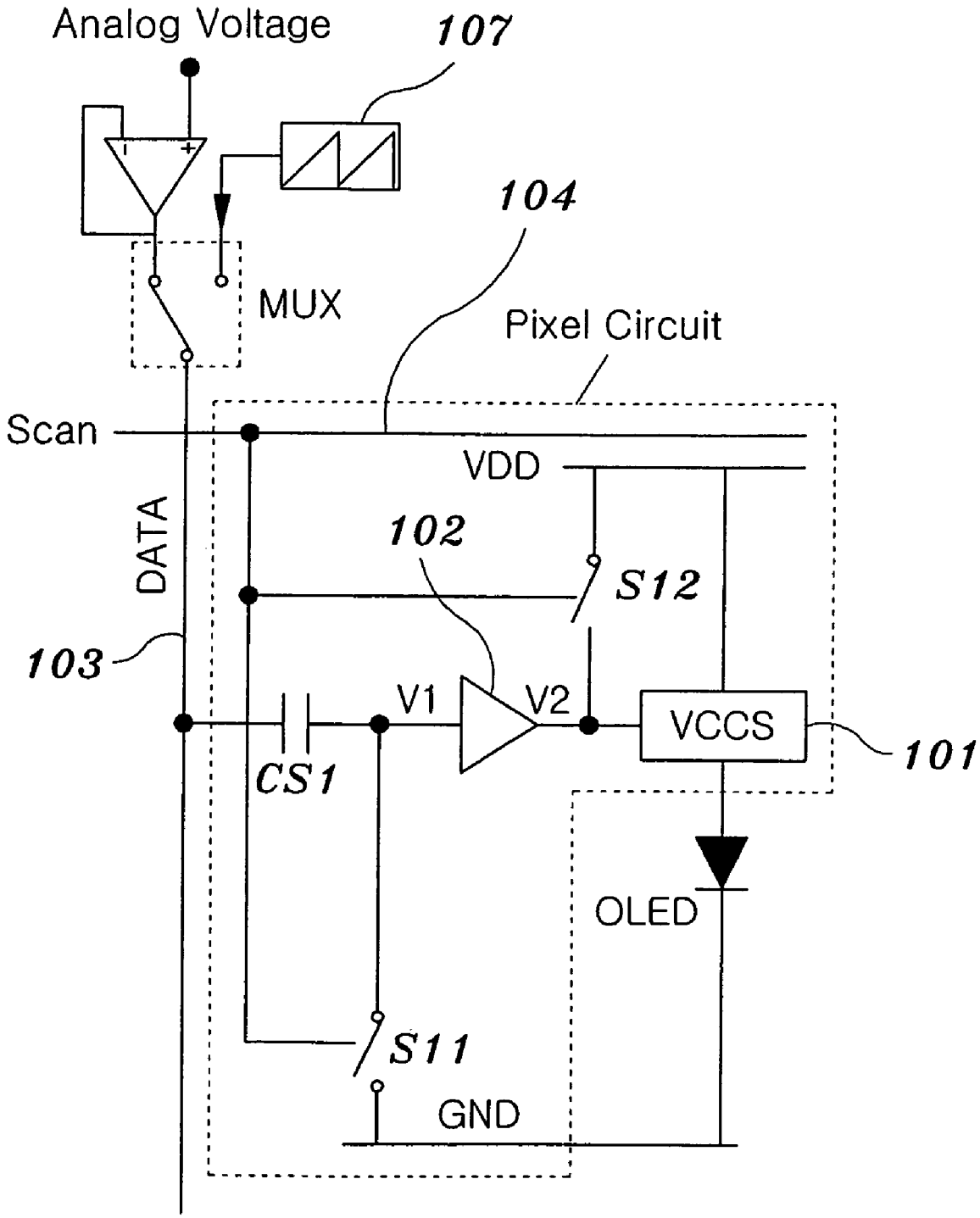

[Figure 4]
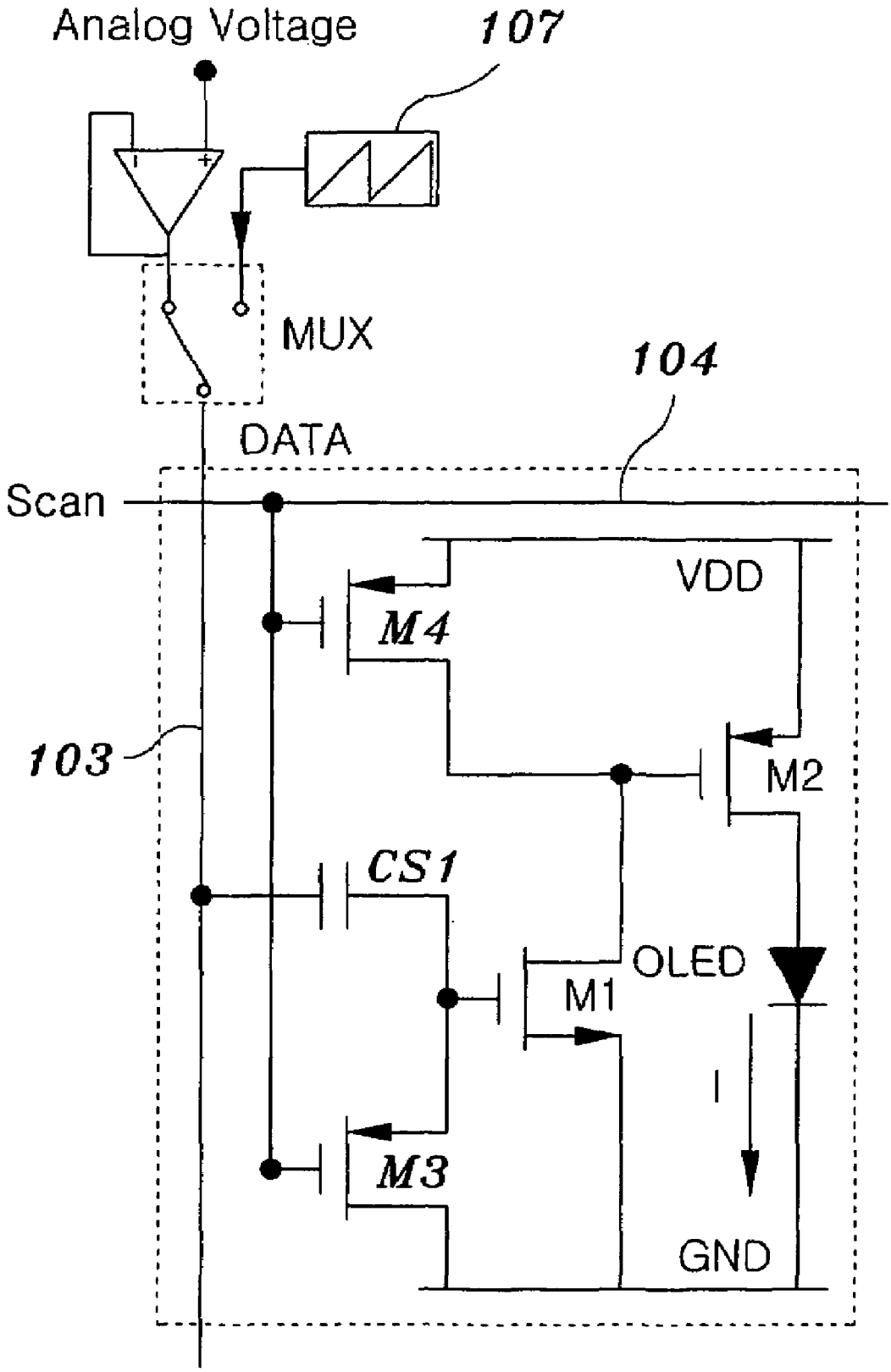

[Figure 5]
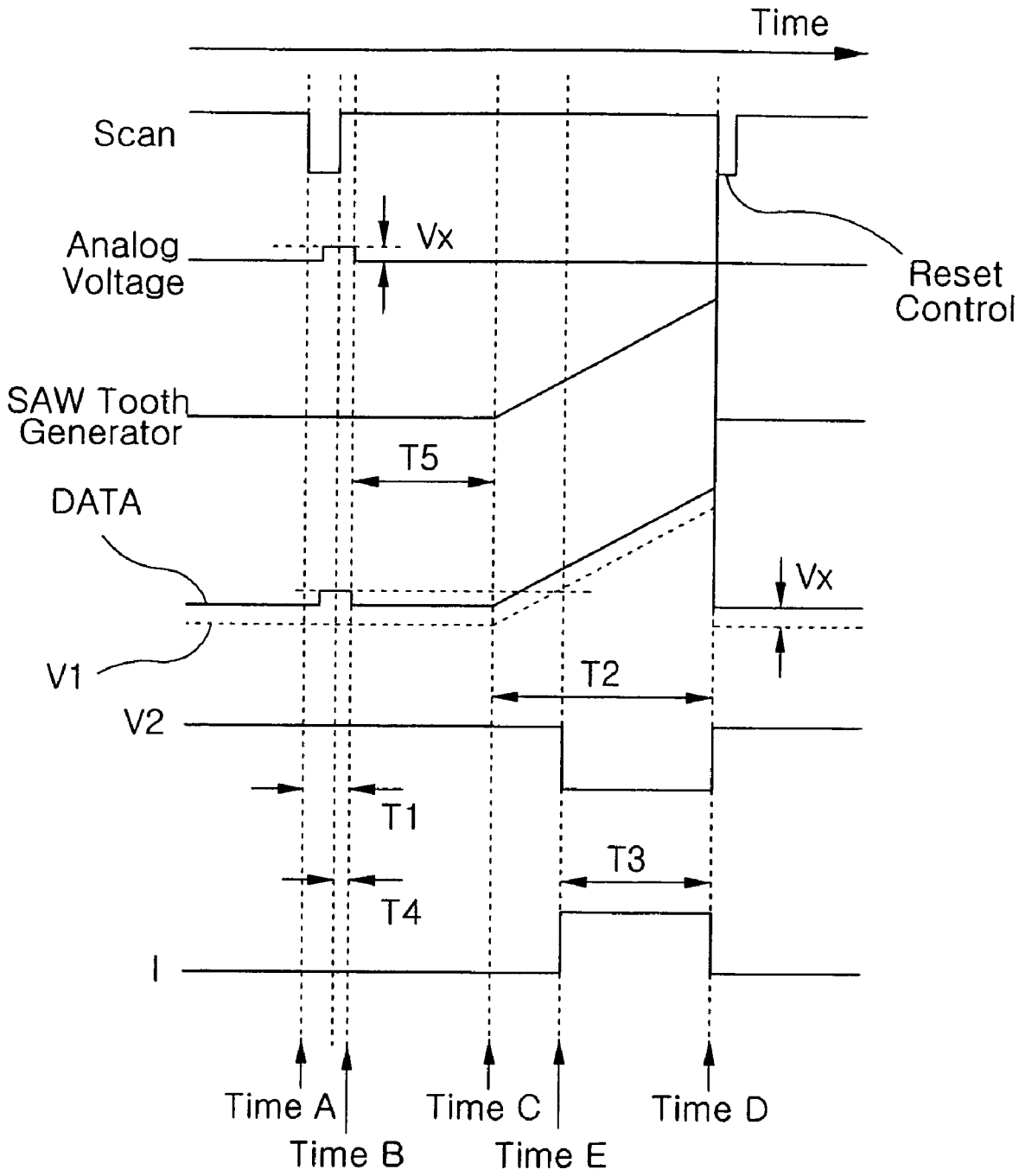

[Figure 6]
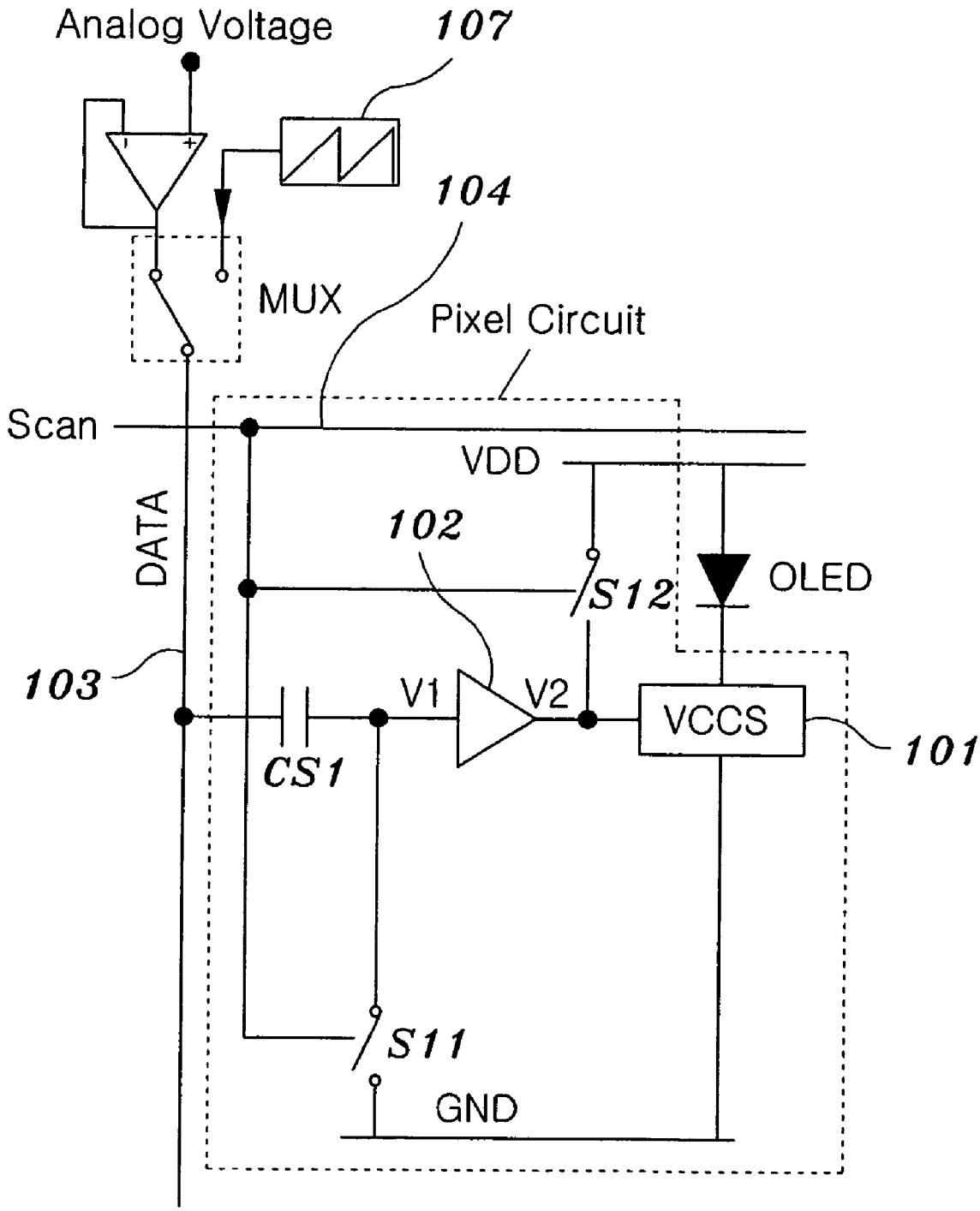

[Figure 7]
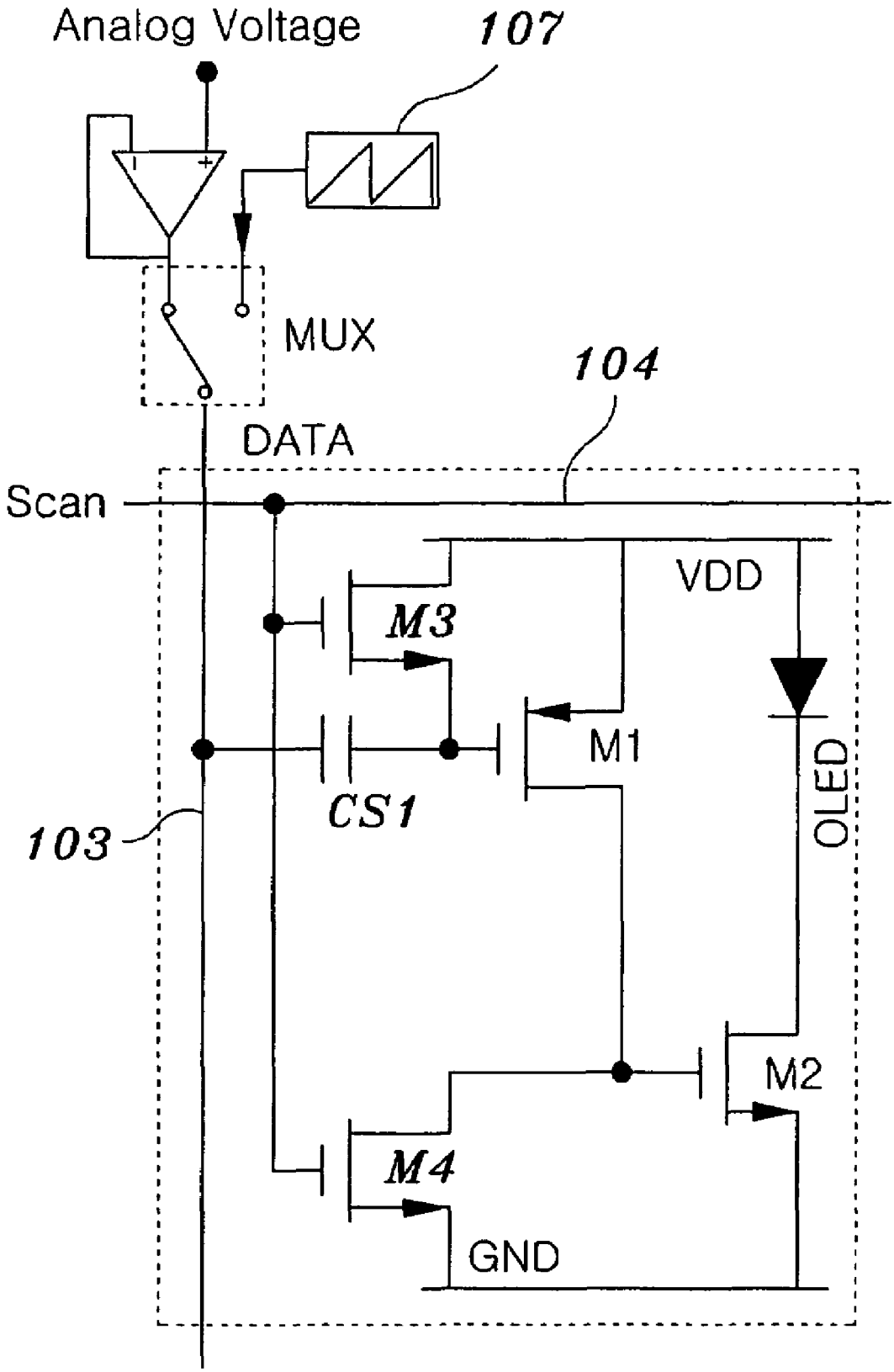

[Figure 8]
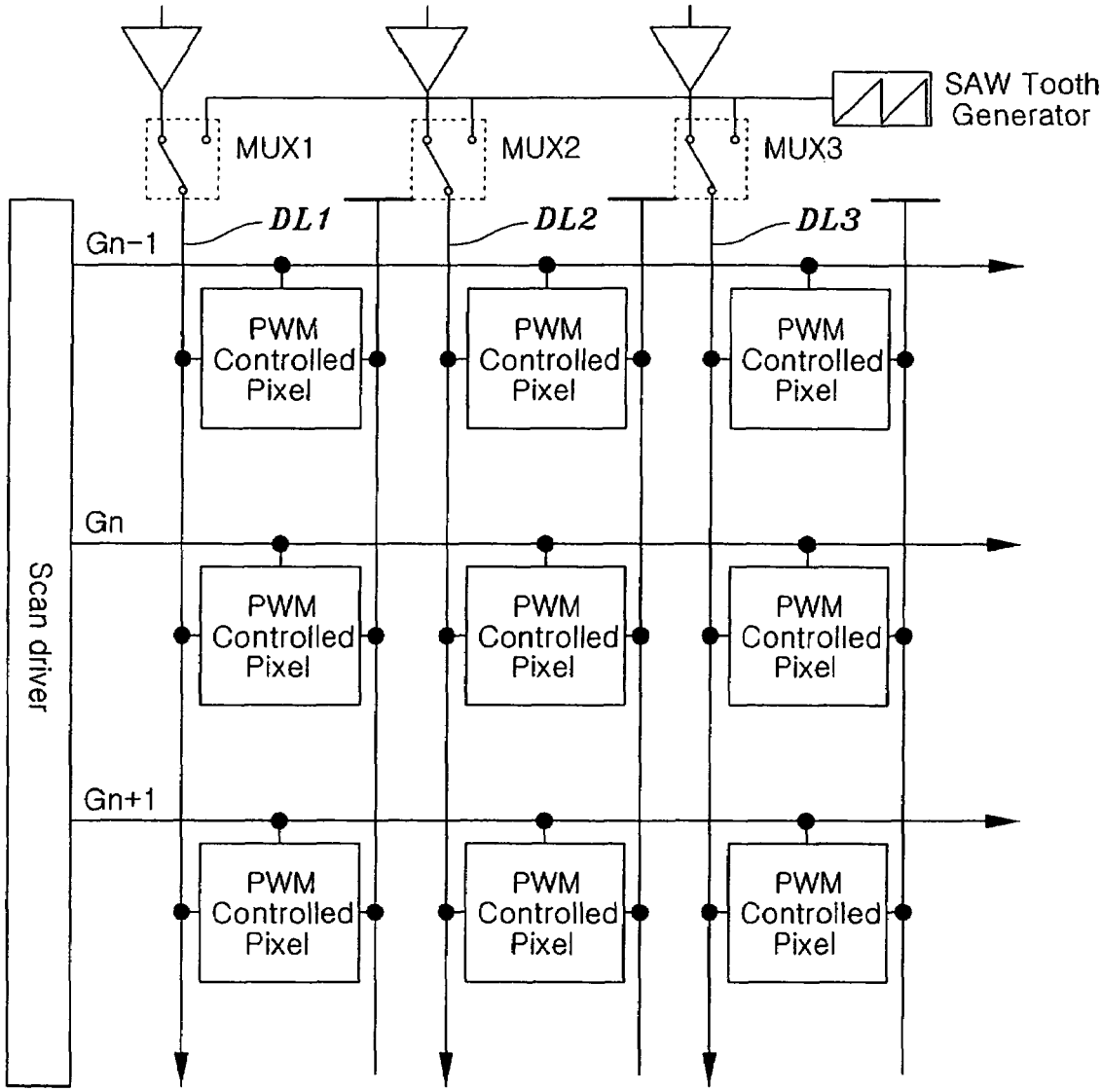

PIXEL CIRCUIT AND DRIVING METHOD FOR ACTIVE MATRIX ORGANIC LIGHT-EMITTING DIODES, AND DISPLAY USING THE SAME

BACKGROUND OF THE INVENTION

1. Field of the Invention

The present invention relates generally to a pixel circuit and driving method for organic light-emitting diodes and, more particularly, to a pixel circuit and driving method for active matrix organic light-emitting diodes, and a display using the pixel circuit, which effectively and accurately control the brightness of organic light-emitting diodes and overcome gradient non-uniformity attributable to pixel-to-pixel mismatch.

2. Description of the Related Art

In recent years, technology for forming a Thin Film Transistor (TFT) on a substrate has been widely developed, and the development of applications related to an active matrix type display is being carried out. In particular, a TFT that employs a polysilicon film has a higher electric field effect mobility than a TFT that employs a conventional amorphous silicon film, so that the former TFT can operate at high speed. As a result, pixel control that has been conventionally carried out by a driving circuit outside a substrate can be carried out by a driving circuit formed on the same substrate as pixels.

Such an active matrix display has attracted attention because it has many advantages, such as decreased manufacturing cost, a decrease in the size of displays, increased yield, and higher throughput, that can be achieved by integrating a variety of circuits and devices with each other on the same substrate.

Currently, research into an active matrix Electro Luminescence (EL) display, including EL devices as self-light-emitting devices, is being actively carried out. The EL display is also referred to as an Organic Light-emitting Diode (OLED) display, and an active matrix OLED display is abbreviated to an AMOLED display.

The organic display is a self-light-emitting type display unlike a Liquid Crystal Display (LCD). Each of the EL devices is constituted such that an EL layer is disposed between a pair of electrodes. When electrons and holes are injected into an organic light-emitting layer formed between a first electrode (negative electrode), that is, a cathode, and a second electrode (positive electrode), that is, an anode, the injected electrons and holes are combined so as to form pairs and, therefore, an exciton is generated. The generated exciton falls from an excited state to a ground state. In this manner, the EL element emits light.

Such an OLED operates by applying a Direct Current (DC) bias of 2 to 30 Volts. The luminescence of the OELD may be controlled by adjusting the voltage or current applied to the anode and the cathode. The relative amount of light generated from the OLED is referred to as a gray level. In general, the OLED operates optimally when operating in a current mode. The optical output thereof is further stabilized by constant current driving compared to constant voltage driving. This is different from many other display technologies that generally operate in a voltage mode. Accordingly, active matrix displays that use OLED technology require a specific pixel structure to provide a current mode.

In the AMOLED that is a matrix address type, a plurality of OLEDs is typically formed on a single substrate and arrayed in the form of regular grid pattern groups. Several OLED groups that form the column of a grid may share a common cathode or a cathode line with each other. Several OLED groups that form the row of a grid may share a common anode or an anode line with each other. A predetermined group of individual OLEDs emit light when the cathode and anode lines are simultaneously activated. Each OLED group within a matrix may form a pixel for display, and each OLED generally serves as a sub pixel or a pixel cell.

The OLED has excellent characteristics, such as a wide field of view, high-speed response, and high contrast, so that they can be used for the pixel of a graphic display, a television image display or a surface light source, can be formed on a flexible, transparent substrate, such as a plastic substrate, can be manufactured very thin and light, and can provide good color. For these reasons, the OLED is expected to be the next generation Flat Panel Display (FPD).

Furthermore, the OLED can represent three colors: RED (R), Green (G) and Blue (B), has low power consumption because a backlight is not required compared to an LCD that is already well known, and provides excellent color, thus attracting attention as a device for a next generation full color display.

FIG. 1 has been disclosed in U.S. Pat. No. 6,781,567, and is one of the fundamental pixel structures for implementing conventional Time Ratio Gray (TRG).

The conventional pixel structure has the problem of an addressing time that is considered the most important problem with respect to implementing the TRG. That is, effective light-emitting time available becomes small in a given frame period in proportion to the increase of the gray scale because a frame time is divided into sub frame times and data programming must be performed for each pixel whenever the operation of each sub frame is performed so as to represent an arbitrary gray-scale, so that it is difficult to implement high level gray scale in the conventional structure.

FIGS. 2*a* and 2*b* are schemes disclosed in the Society for Information Display (SID) 2003 and SID 2004, and the pixel circuit of FIG. 2*a* is disadvantageous in that shoot-through current occurs at the time of the operation of a Complementary Metal-Oxide-Silicon (CMOS) inverter, and a control signal for controlling light-emitting time is added.

In FIG. 2*b*, the shoot-through of the pixel circuit of FIG. 2*a* has been eliminated, but there are disadvantages in that a separate control line is still needed and it is difficult to implement gray-scale uniformity when a transistor T5 exhibits different characteristics between pixels.

SUMMARY OF THE INVENTION

Accordingly, the present invention has been made keeping in mind the above problems occurring in the prior art, and an object of the present invention is to provide a pixel circuit and driving method for active matrix OLEDs, and a display using the pixel circuit, which implement both pixel selection and gradient implementation using only data and scan lines, and overcome gradient non-uniformity attributable to pixel-to-pixel mismatch.

In order to accomplish the above object, the present invention provides a pixel circuit for active matrix OLEDs, including a Voltage Control Current Source (VCCS) configured to drive the OLEDS; a high gain amplifier configured such that the control input signal of the VCCS causes the VCCS to be placed in an ON or OFF state; a storage capacitor located between the input terminal of the high gain amplifier and a data line so as to assign the ON-time of the VCCS; and first and second switches configured to be controlled through a scan line so as to store voltage in the storage capacitor and control the light-emitting time of the OLEDs, and formed at input terminal of the high gain amplifier and the input terminal of the VCCS, respectively.

In addition, the present invention provides a method of driving a pixel circuit for active matrix OLEDs, including the step of using a sawtooth wave as a data line signal that controls a light-emitting period, so as to use a scan line not only as a control signal line for selecting a arbitrary pixel during data programming for indicating a gray level of the pixel but also as a reset control signal line.

In addition, the present invention provides a display using a pixel circuit for active matrix OLEDs, including a plurality of pixel circuits constructed in an array form, each of the pixel circuits comprising a VCCS configured to drive the OLEDs, a high gain amplifier configured to cause control the input signals of the VCCS to be placed in an off state or an on state, and a storage capacitor located between the input terminal of the high gain amplifier and a data line so as to assign the ON-time of the VCCS, and first and second switches configured to be controlled through a scan line so as to store voltage in the storage capacitors and control the light-emitting time of the OLEDs, and formed at the input terminal of the high gain amplifier and the input terminal of the VCCS, respectively; multiplexers connected to respective data lines; and a sawtooth wave generator connected to the data lines via the multiplexers; wherein a light-emitting period of a pixel connected to the data line is controlled using the sawtooth wave generator.

BRIEF DESCRIPTION OF THE DRAWINGS

The above and other objects, features and advantages of the present invention will be more clearly understood from the following detailed description taken in conjunction with the accompanying drawings, in which:

FIG. 1 is a circuit diagram showing a conventional pixel structure for implementing TRG;

FIGS. 2*a* and 2*b* are pixel circuit diagrams disclosed in SID 2003 and SID 2004, respectively;

FIG. 3 is a conceptual diagram showing the construction of a pixel circuit for active matrix OLEDs according to the present invention;

FIG. 4 is a circuit diagram showing an embodiment of FIG. 3;

FIG. 5 is the operational timing diagram of the embodiment of FIG. 4;

FIG. 6 is a conceptual diagram showing a construction complementary to FIG. 3;

FIG. 7 is a circuit diagram showing an embodiment of FIG. 6; and

FIG. 8 is a diagram showing an example of a display array to which the pixel circuit of the present invention is applied.

DESCRIPTION OF THE PREFERRED EMBODIMENTS

An embodiment of the present invention is described in detail with reference to the accompanying drawings below. The following embodiments only illustrate examples of the present invention, and the present invention is not limited to the following embodiments.

FIG. 3 is a conceptual diagram showing the construction of a pixel circuit for active matrix OLEDs according to the present invention, FIG. 4 is a circuit diagram showing an embodiment of FIG. 3, and FIG. 5 is the operational timing diagram of the embodiment of FIG. 4. With reference to the drawings, the principle of the present invention is briefly described below.

The present invention employs a single storage capacitor CS1 connected to a data line 103 not only to drive each pixel, which is provided in an active matrix array, to a desired brightness but also to select a arbitrary pixel and store data (voltage) corresponding to desired brightness in the selected pixel. Furthermore, the present invention employs only data and scan lines 103 and 104 to control a light-emitting period.

Two switch components are used to control the operation required for each period. A high gain amplifier is used such that the control input signal of a Voltage Controlled Current Source (VCCS) that drives the OLEDs of each pixel causes the VCCS to be placed in an ON or OFF state. Furthermore, a sawtooth wave is used as a second input signal, which is input to the data line, to define an exact light-emitting time of each pixel.

Furthermore, the control period of the pixel circuit for the active matrix OLEDs according to the present invention is divided into a data-programming period (T1 of FIG. 5) and a light-emitting period (T2 of FIG. 5).

The data-programming period includes a required time and a switching operation to store an analog voltage value necessary for achieving a desired brightness, in the storage capacitor CS1 of FIG. 3. A sawtooth wave, that is, a sawtooth sweep signal, is applied to the data line 103 after the light-emitting period, thus allowing effective light-emitting time (T3 of FIG. 5) to be controlled depending on the voltage value programmed within the data programming period.

The data programming period is defined as a period ranging from time A to time B, and the light-emitting period is defined as a period ranging from time C to time D.

A delay ranging from time B to time C exists between the data programming period and the light-emitting period, and is determined depending on not only a display system but also a display matrix array structure and the number of scan lines that depend on a display format.

Furthermore, to overcome gradient non-uniformity attributable to Pixel-to-Pixel mismatch, the present invention allows the control state of devices (the VCCS of FIG. 3 or 6 and the switch M2 of FIG. 7 that will be described later) to be placed in either an ON or OFF state. For this purpose, it is necessary to digitize the control input signals of the devices. To digitize the control input signals, the output of the high gain amplifier 102 is used as the control input signal of the VCCS 101 of FIG. 3 or 6.

Furthermore, the present invention employs the data line 103 and the scan line 104 to control the light-emitting period. The reason why this is possible is because a sweep signal used for the light-emitting period has a sawtooth wave form and the time when the rising slope thereof is completed becomes the time when the light-emitting periods of all pixels are completed, so that the high gain amplifier 102 and the VCCS 101 can be reset by applying an appropriate signal.

The present invention is described in more detail below based on the above-described concept.

As shown in FIG. 3 that is the conceptual diagram of the present invention, the pixel circuit for active matrix OLEDs is configured to input the control signal of the VCCS 101, which supplies OLEDs with current, through the high gain amplifier 102 so as to digitally drive the OLEDs. The storage capacitor CS1 is disposed between the input terminal of the high gain amplifier 102 and the data line 103 to perform programming for the ON period of the VCCS 101, and switches S11 and S12, which are controlled through the scan line 104, are provided to the input terminal of the high gain amplifier 102 and the input terminal of the VCCS 101, respectively, so as to perform programming for storing data in the storage capacitor CS1 and control light-emitting time. The ends of the switches S11 and S12 are connected to a ground GND and a DC voltage source VDD and, respectively.

FIG. 4 is a circuit diagram showing an embodiment of FIG. 3, in which each of the switches is implemented using a P-channel TFT, the VCCS 101 is implemented using a P-channel TFT, and the high gain amplifier is implemented using a N-channel, the operation of which is described in detail with reference to the operational timing diagram of FIG. 5.

In the data-programming period, a pixel is selected and the voltage of the scan line 104 is changed from a non-selected state to a selected state to define an initial state, so that the switches M3 and M4 are turned on (the scan of FIG. 5).

In this case, the state of the data line 103 is determined so that an input, such as the analog voltage of FIG. 5, can be applied from an analog voltage source by controlling the state of a multiplexer MUX, and an analog voltage value Vx is maintained for some time (T4 of FIG. 5) when the scan line 14 enters into a non-selected state to sufficiently guarantee operational safety. After the data-programming period of FIG. 5, a constant delay T5 is a value that varies with an array structure and addressing speed when a pixel array is constructed and used.

In the light-emitting period, a waveform, such as the sawtooth wave of FIG. 5, which is generated from a sawtooth wave generator 107, is allowed to be applied by controlling the state of the multiplexer MUX. A maximal emitting time is determined by the pulse width T2 of the sawtooth wave of the FIG. 5.

The actual waveform of the data line 103 is represented as DATA of FIG. 5 by the control of the scan line, the input of the analog voltage and the application of the sawtooth wave. When such a waveform is input to the data line 103, the programming analog voltage value Vx has been stored in the storage capacitor CS1 in the data programming period, so that the input terminal voltage V1 of the high gain amplifier 102 of FIG. 3 has voltage difference identical to the voltage Vx, and the waveform of the data line 103 is duplicated without change (the dotted line waveform V1 of FIG. 5).

Accordingly, the time when the N-channel TFT M1 of FIG. 4 corresponding to the high gain amplifier 102 of FIG. 3 is turned on becomes the approximate time when the voltage V1 begins to be higher than the threshold voltage Vth of the TFT M1, and the light-emitting period starts from this time (Time E of FIG. 5).

The TFT M1 of FIG. 4 operates as an inverting amplifier having a large load, and the gain of the amplifier constructed by the TFT M1 is very large, so that the input voltage V2 of a P-channel TFT M2 corresponding to the VCCS 101 becomes a low state at time E of FIG. 5, the TFT M2 enters into an ON state, and, therefore, saturation current begins to be supplied to the OLEDS.

In this case, even when the voltage V2 of FIG. 5 changes very sharply and the threshold voltage or mobility of the TFT M2 differs between pixels, the effect of the difference therebetween is cancelled.

As a result, it can be seen that the waveform of current supplied to the OLEDs is represented as I of FIG. 5 and, therefore, the OLEDs are digitally driven.

When the light-emitting period is completed, the voltage of the data line 103 drives the TFT M1 of FIG. 4 to be turned off. However, the gate voltage of the TFT M2 cannot drive the TFT M2 to be turned off by causing the TFT M1 to be turned off, so that the light-emitting period can be accurately controlled by applying a short reset signal to the scan line.

That is, the greatest advantage of the present invention is the accurate control of the light-emitting period without a separate control line. This is feasible because the light-emitting period is controlled by a Pulse Width Modulation (PWM) scheme using a sawtooth wave.

When a triangular wave type of sweep signal is used instead of the sawtooth wave, a reset signal cannot be applied to the scan line because the time points at which the light emission of pixels are completed are different from each other.

As described above, the operational timing diagram of the present invention may be divided into three periods: the data programming period, the light-emitting period, and the delay of each period. In the data programming period and the light-emitting period, a signal input to the data line 103 is controlled by the multiplexer MUX, and is set to differ between the times of programming and light-emitting.

In the light-emitting period, the effective light-emitting time is defined by the analog voltage and the sawtooth wave applied in the data programming period, and two control signals corresponding to the data line 103 and the scan line 104 are necessary for performing data programming and light-emitting.

The present invention has a great feature in that a separate signal line for switch control is not used. Various slopes are applied to the sawtooth wave, so that effective gamma control can be performed without changing an existing data format.

FIG. 7 is a circuit diagram showing a construction complementary to FIG. 4, and shows an embodiment of the conceptual diagram of FIG. 6. The circuit diagram is constructed by inverting the channel types of the TFTs of FIG. 4. The fundamental operation principle of the embodiment is the same as that of FIG. 4, and it is different in that control signals for pixel selection are simply changed.

FIG. 8 is an example that implements the pixel of FIG. 4 in an array form. In this example, an active matrix OLED array is driven using driver chip or System on Glass (SOG) technology, and is implemented such that a sawtooth wave generator, which is an input source to the data line DL1 to DL3, is further shared as a common input to multiplexers Mux1 to Mux3 connected to data lines DL1 to DL3 when the light-emitting period is controlled.

In such a construction, the multiplexers Mux1 to Mux3 connected to the data lines DL1 to DL3, respectively, are classified to correspond to R, G and B, and share the sawtooth wave generator that is a input source to the respective data input lines DL1 to DL3, and different rising functions are applied to a sawtooth wave, so that different R, G and B gamma corrections can be performed.

As described above, the present invention can achieve pixel selection and gradient implementation only using data and scan lines in the active matrix OLED display, and can overcome gradient non-uniformity using additional pulse width modulation along with analog voltage driving. Furthermore, in the implementation of the active matrix OLED array, the number of wires necessary for controlling the pixel selection and the light-emitting time is minimized.

Furthermore, only the sawtooth wave generator and the multiplexers are added without great change to the structure of an existing TFT-LCD driver chip, so that an active matrix OLED driver chip can be implemented. Furthermore, a pixel structure and an array structure can be provided so as to enable the application of a driving scheme that facilitates optimal gamma correction for increasing overall power efficiency. Furthermore, a driving scheme, which enables the representation of a high gradation without a high system clock frequency, can be applied.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A pixel circuit for active matrix Organic Light-emitting Diodes (OLEDs) comprising:

a Voltage Control Current Source (VCCS) configured to drive the OLEDs;

a high gain amplifier configured such that a control input signal of the VCCS causes the VCCS to be placed in an ON or OFF state;

a storage capacitor located between an input terminal of the high gain amplifier and a data line so as to assign ON-time of the VCCS; and a first switch configured to be controlled through a scan line so as to store the voltage in the storage capacitor and control light-emitting time of the OLEDs, the first switch having one terminal connected to ground (GND) and the other terminal connected to an input terminal of the high gain amplifier;

a second switch configured to be controlled through the scan line so as to store voltage in the storage capacitor and control light-emitting time of the OLEDs, the second switch having one terminal connected to the output terminal of the high gain amplifier and the other terminal connected to a power source.

2. The pixel circuit as set forth in claim 1, wherein the VCCS is implemented using a P-channel Thin Film Transistor (TFT), the high gain amplifier is implemented using a N-channel TFT, and each of the first and second switches is implemented using a P-channel TFT.

3. The pixel circuit as set forth in claim 1, wherein the VCCS is implemented using an N-channel TFT, the high gain amplifier is implemented using a P-channel TFT, and each of the first and second switches is implemented using an N-channel TFT.

4. A method of driving a pixel circuit for active matrix OLEDs, comprising the step of using a sawtooth wave as a data line signal that controls a light-emitting period, so as to use a scan line not only as a control signal line for selecting a arbitrary pixel during data programming for indicating a gray level of the pixel but also as a reset control signal line, wherein the pixel circuit comprises a Voltage Control Current Source (VCCS) configured to drive the OLEDs;

a high gain amplifier configured such that a control input signal of the VCCS causes the VCCS to be placed in an ON or OFF state;

a storage capacitor located between an input terminal of the high gain amplifier and a data line so as to assign ON-time of the VCCS;

a first switch configured to be controlled through a scan line so as to store the voltage in the storage capacitor and control light-emitting time of the OLEDs, the first switch having one terminal connected to ground (GND) and the other terminal connected to an input terminal of the high gain amplifier; and a second switch configured to be controlled through the scan line so as to store voltage in the storage capacitor and control light-emitting time of the OLEDs, the second switch having one terminal connected to the output terminal of the high gain amplifier and the other terminal connected to a power source.

5. The method as set forth in claim 4, wherein a gamma correction is performed by a variety of rising functions at a rising time of the sawtooth wave.

6. The method as set forth in claim 5, wherein the gamma correction is performed using different Red (R), Green (G), Blue (B) when the variety of rising functions are applied at the rising time of the sawtooth wave.

7. A display using a pixel circuit for active matrix OLEDs, comprising:

a plurality of pixel circuits constructed in an array form, each of the pixel circuits comprising a VCCS configured to drive the OLEDs, a high gain amplifier configured to cause control input signals of the VCCS to be placed in an off state or an on state, and a storage capacitor located between an input terminal of the high gain amplifier and a data line so as to assign ON-time of the VCCS, a first switch configured to be controlled through a scan line so as to store the voltage in the storage capacitor and control light-emitting time of the OLEDs, the first switch having one terminal connected to ground (GND) and the other terminal connected to an input terminal of the high gain amplifier;

a second switch configured to be controlled through the scan line so as to store voltage in the storage capacitor and control light-emitting time of the OLEDs, the second switch having one terminal connected to the output terminal of the high gain amplifier and the other terminal connected to a power source;

multiplexers connected to respective data lines; and a sawtooth wave generator connected to the data lines via the multiplexers;

wherein a light-emitting period of a pixel connected to the data line is controlled using the sawtooth wave generator.

8. The display as set forth in claim 7, wherein the multiplexers, which are connected to correspond to the data line, are classified according to R, G or B, the sawtooth wave generator is shared by the multiplexers, and different rising functions are applied to a sawtooth wave output from the sawtooth wave generator, so that different R, G and B gamma corrections are performed.

9. The pixel circuit of claim 1, wherein the circuit has only one capacitor, and wherein the only one capacitor is the storage capacitor.

10. The method of claim 4, wherein the circuit has only one capacitor, and wherein the only one capacitor is the storage capacitor.

11. The display of claim 7, wherein the circuit has only one capacitor, and wherein the only one capacitor is the storage capacitor.

* * * * *

UNITED STATES PATENT AND TRADEMARK OFFICE

CERTIFICATE OF CORRECTION

PATENT NO. : 7,609,234 B2
APPLICATION NO. : 11/232819
DATED : October 27, 2009
INVENTOR(S) : Cho et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1034 days.

Signed and Sealed this

Twelfth Day of October, 2010

David J. Kappos

David J. Kappos
*Director of the United States Patent and Trademark Office*